US009259778B2

(12) United States Patent
Wang et al.

(10) Patent No.: US 9,259,778 B2
(45) Date of Patent: Feb. 16, 2016

(54) RIVETING PUNCH

(71) Applicants: Fu Tai Hua Industry (Shenzhen) Co., Ltd., Shenzhen (CN); HON HAI PRECISION INDUSTRY CO., LTD., New Taipei (TW)

(72) Inventors: Xing-Zhi Wang, Shenzhen (CN); Zheng-Gang Xu, Shenzhen (CN)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/555,692

(22) Filed: Nov. 28, 2014

(65) Prior Publication Data

US 2015/0151353 A1 Jun. 4, 2015

(30) Foreign Application Priority Data

Nov. 30, 2013 (CN) ..... 2013 1 0622201

(51) Int. Cl.
*B21J 15/18* (2006.01)

(52) U.S. Cl.
CPC ..... *B21J 15/18* (2013.01)

(58) Field of Classification Search
CPC ..... B21J 15/18
USPC ..... 72/453.01
See application file for complete search history.

(56) References Cited

U.S. PATENT DOCUMENTS 2,511,506 A * 6/1950 Hruby, Jr. ..... B21J 15/10 72/19.7
2,769,228 A * 11/1956 Burge ..... H02B 3/00 198/340

* cited by examiner

*Primary Examiner* — David B Jones
(74) *Attorney, Agent, or Firm* — Novak Druce Connolly Bove + Quigg LLP

(57) ABSTRACT

A riveting punch employed to punch an annular workpiece into a riveting hole defined on another workpiece. The riveting punch includes a punching member and a positioning member coupled to the punching member. The punching defines a first gas channel extending through a first end, and a mounting hole and a number of suction holes extending through a second end. The suction holes communicate with the first gas channel, and are arranged around the mounting hole. A first end of the positioning member is securely received in the mounting hole, and a second end of the positioning member has a positioning end. The guide end includes a positioning portion configured to match with the annular workpiece, and a guide portion extending from an end of the positioning portion. The guide portion includes a curved guide surface on an end.

10 Claims, 4 Drawing Sheets

RIVETING PUNCH

FIELD

The subject matter herein generally relates to the field of machining processes.

BACKGROUND

A riveting punch is employed to punch a riveting nut into a workpiece in machining

BRIEF DESCRIPTION OF THE DRAWINGS

Implementations of the present technology will now be described, by way of example only, with reference to the attached figures.

DETAILED DESCRIPTION

Figure 1:
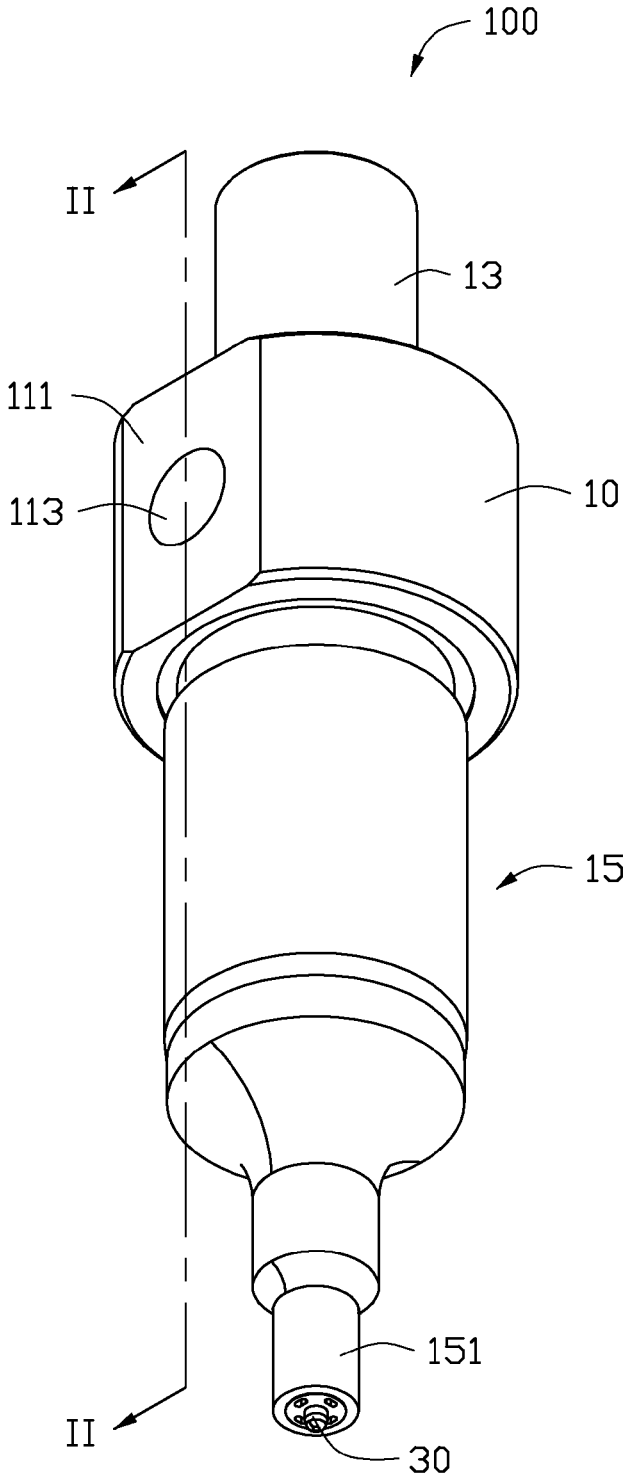
FIG. 1 is an isometric view of a first embodiment of a riveting punch.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

A riveting punch can include a main body having a first gas channel along a central axis thereof, a punching end formed on an end of the main body, and a positioning member. The punching end can have a mounting hole along the central axis thereof, and a plurality of suction holes around the mounting hole in fluid communication with the first gas. The positioning member can have a first end securely received in the mounting hole, and a second end with a positioning portion configured to match a workpiece. A diameter of the positioning portion can decrease over at least part of its length to define a curved guide surface.

Figure 2:
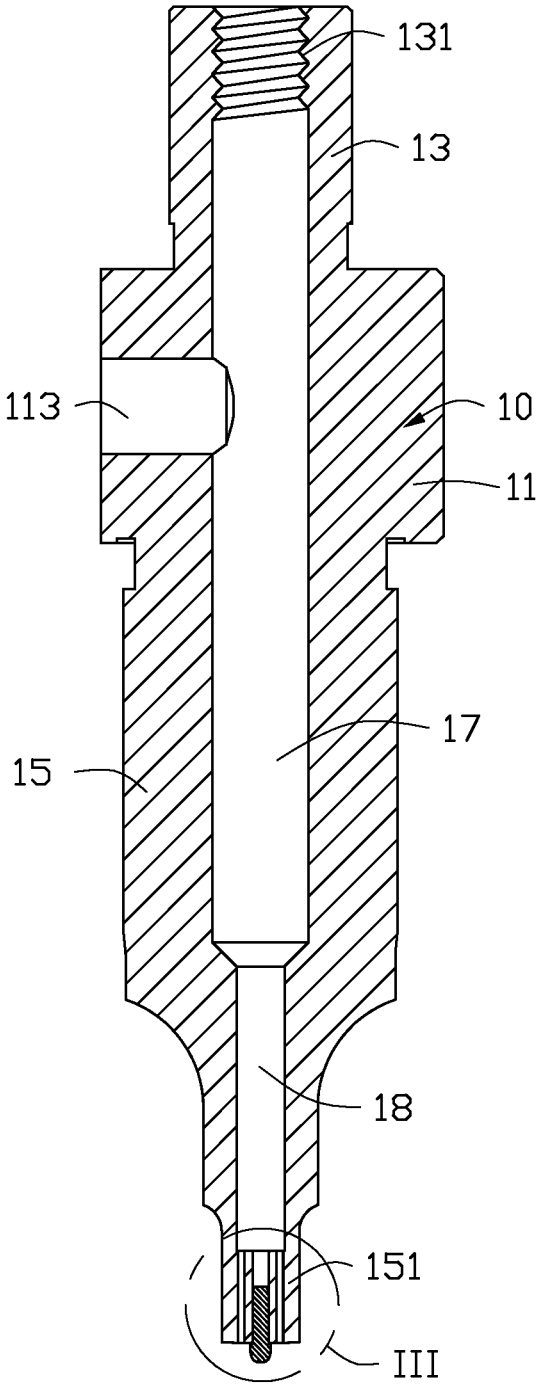
FIG. 2 is a cross-sectional view of the riveting punch of FIG. 1, taken along line II-II of FIG. 1.

FIGS. 1 and 2 illustrate an embodiment of a riveting punch 100. The riveting punch 100 can include a punching member 10, and a positioning member 30 coupled to the punching member 10. The riveting punch 100 can be configured to vacuum-lift an annular workpiece (not shown), such as a riveting nut, and can punch the annular workpiece (not shown) into a riveting hole defined on another workpiece (not shown) further. The positioning member 30 can be configured to position the annular workpiece.

The punching member 10 can be substantially cylindrical, and can include a main body 11, a mounting portion 13, and a riveting portion 15. The mounting portion 13 and the riveting portion 15 can each extend from opposite ends of the main body 11. The punching member 10 can define a first gas channel 17 extending through the main body 11 and the mounting portion 13 along a central axis of the punching member 10. The riveting portion 15 can define a second gas channel 18 communicating with the first gas channel 17. A diameter of the second gas channel 18 can be less than that of the first gas channel 17, thus a vacuum or negative pressure environment can be formed in the punching member 10 to evacuate air in the first gas channel 17 and the second gas channel 18.

The main body 11 can be substantially cylindrical. The main body 11 can include a tangent plane 111 formed on a sidewall thereof, and can define a connecting hole 113 on the tangent plane 111. The connecting hole 113 can extend through the sidewall to communicate with the first gas channel 17, and can be configured to be coupled to a suction pipe (not shown). The mounting portion 13 can be coaxial with the main body 11, and can define a thread portion 131 around the first gas channel 17 on the inner sides. The thread portion 131 can be configured to receive a screw (not shown).

FIG. 2 illustrates that the diameter of the riveting portion 15 can gradually decrease away from the main body 11.

Figure 3:
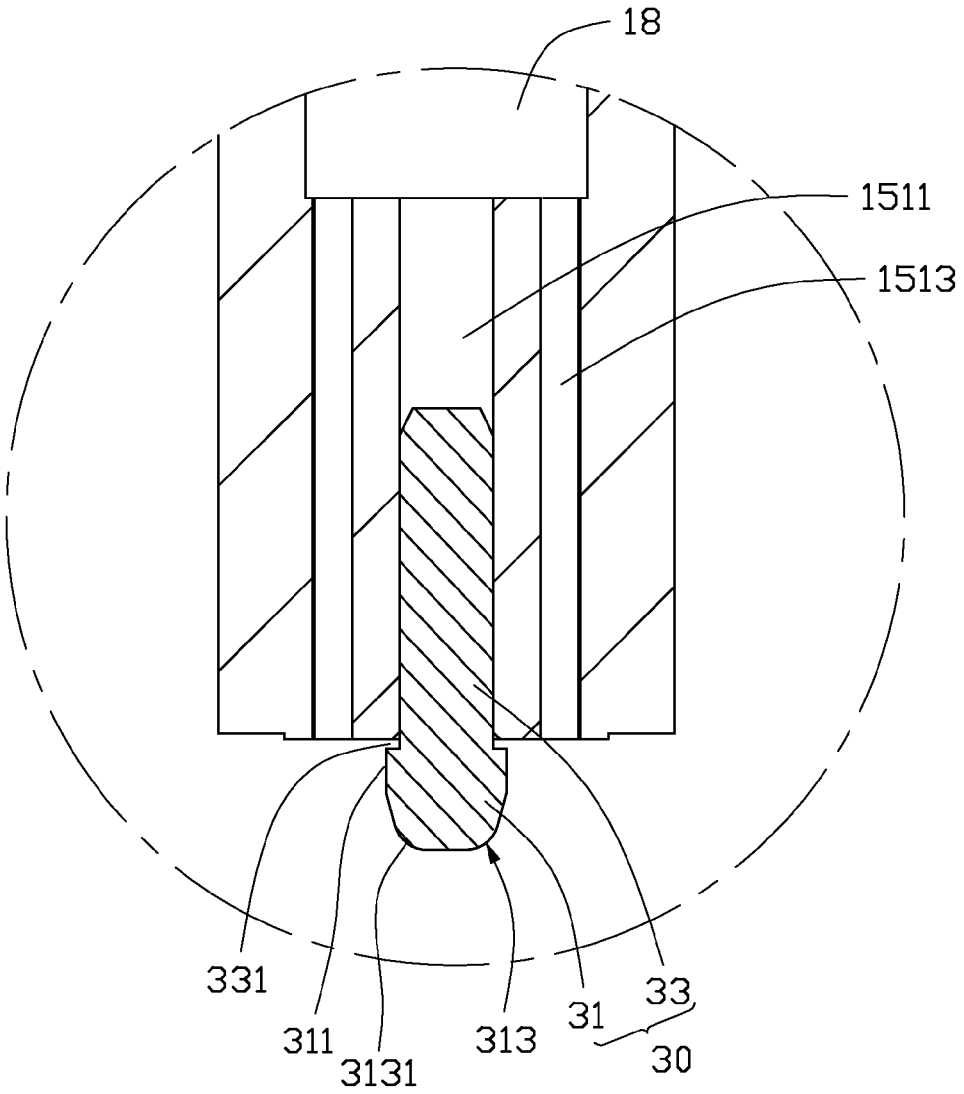
FIG. 3 is an enlarged view of circled portion III of FIG. 2.

FIG. 3 illustrates that a punching end 151 can be formed on the end of the riveting portion 15 away from the main body. The punching end 151 can be substantially cylindrical and can have a uniform diameter. The punching end 151 can define a mounting hole 1511 and a number of suction holes 1513. The mounting hole 1511 can extend along the central axis of the punching end 151, through an end surface of the punching end 151 away from the main body 11, and can be arranged on a centre of the end surface of the punching end 151. The suction holes 1513 can be evenly arranged around the mounting hole 1511, spaced a predetermined distance from each other, and can extend through opposite ends of the punching end 151 to communicate with the second gas channel 18. In at least one embodiment, the punching end 151 can define four wasted suction holes 1513.

The positioning member 30 can be substantially cylindrical. The positioning member 30 can include a positioning end 31, and a connecting portion 33 extending from an end of the positioning end 31. The positioning end 31 can include a positioning portion 311, and a guide portion 313 formed on an end of the positioning portion 311 away from the connecting portion 33. The diameter of the positioning portion 313 can be the same as an inner diameter of the annular workpiece (not shown), thus the positioning portion 313 can match with the annular workpiece. The diameter of the guide portion 313 can gradually decrease away from the punching end 151, although this need not be uniform. The guide portion 313 can include a curved guide surface 3131.

The diameter of the connecting portion 33 can be less than that of the positioning end 31, and can be securely received in the mounting hole 1511 of the riveting portion 15 by interference fit. In this way, the positioning member 30 can be fixed to the punching end 151 of the punching member 10. The connecting portion 33 can partially protrude out of the riveting portion 15. The positioning end 31 of the positioning member 30 and the punching end 151 of the punching member 10 can cooperatively define a space 331 therebetween, which forms a lip or gap. The space 331 can extend around a periphery of the connecting portion 33. In at least one embodiment, the positioning member 30 can be a pin.

In use, the riveting punch 100 can move the positioning member 30 to the annular workpiece, and the positioning end 31 can be inserted into the annular workpiece. The guide surface 3131 can lead the annular workpiece to the positioning portion 311, thus presenting the annular workpiece to the punching end 151 of the punching member 10. The punching end 151 can vacuum-lift the annular workpiece via the suction holes 1513 under a negative pressure. The riveting punch 100 can move the annular workpiece to another workpiece, and can press the annular workpiece into the riveting hole of another workpiece according to the punching end 151.

Figure 4:
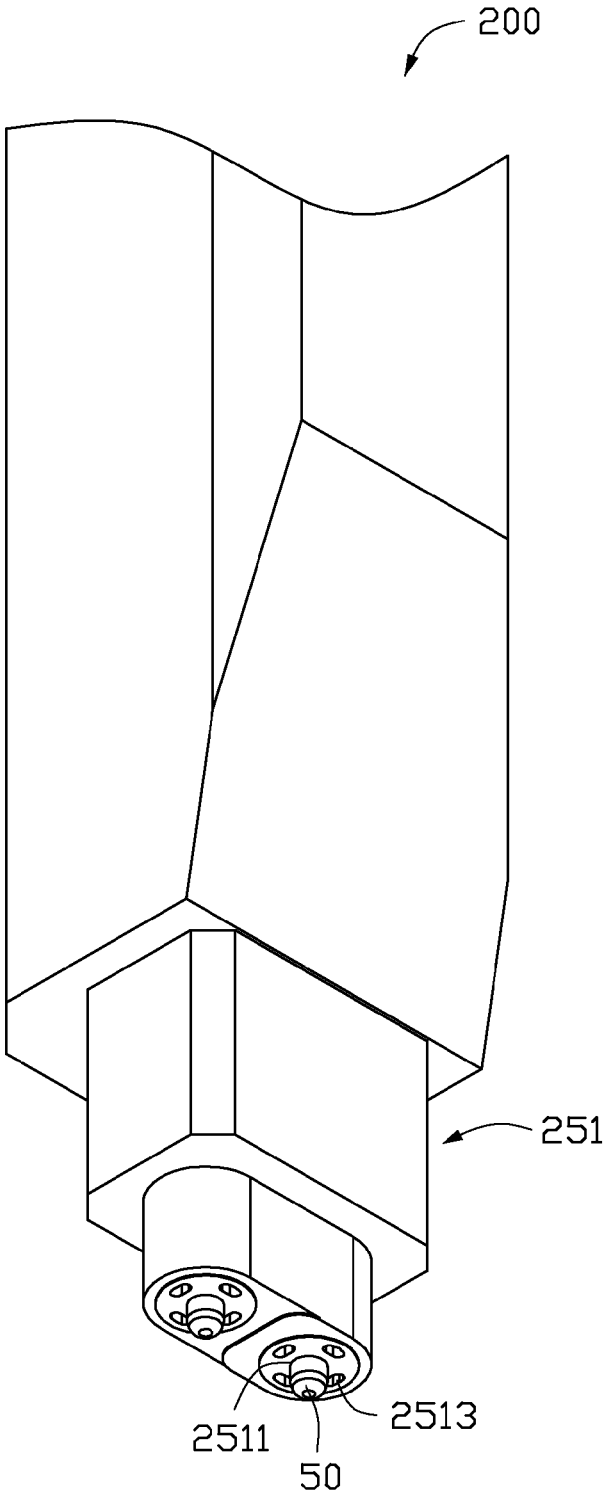
FIG. 4 is an isometric view of a second embodiment of a riveting punch.

FIG. 4 illustrates a second embodiment of a riveting punch 200. The riveting punch 200 can include two sets of suction holes 2513 formed on the punching end 251. Each set of suction holes 2513 can be arranged around one mounting hole 2511. Each mounting hole 2511 can be configured to receive one positioning member 50.

In at least one embodiment, the guide surface 3131 can be substantially hemispherical. In at least one embodiment, the end surface of the punching end 151 can be changed according to need.

In at least one embodiment, the riveting punch 200 can include multiple suction holes 2513 and a number of positioning members 50.

While the present disclosure has been described with reference to particular embodiments, the description is illustrative of the disclosure and is not to be construed as limiting the disclosure. Therefore, those of ordinary skill in the art can make various modifications to the embodiments without departing from the scope of the disclosure, as defined by the appended claims.

What is claimed is:

1. A riveting punch, comprising:

a main body having a first gas channel along a central axis thereof;

a punching end formed on an end of the main body having a mounting hole along the central axis thereof, and a plurality of suction holes around the mounting hole in fluid communication with the first gas channel; and a positioning member having a first end securely received in the mounting hole and a second end with a positioning portion configured to match a workpiece, a diameter of the positioning portion decreasing over at least part of its length to define a curved guide surface.

2. The riveting punch of claim 1, wherein the positioning member further comprises a connecting portion extending from an end of the positioning end away from the guide portion, the connecting portion is securely received in the mounting hole by interference fit.

3. The riveting punch of claim 2, wherein the connecting portion partially protrudes out of the riveting punching end, the positioning end and the punching end cooperatively define a space therebetween, and the space extends around a periphery of the connecting portion.

4. The riveting punch of claim 1, wherein the riveting punch further comprises a mounting portion and a riveting portion each extending from opposite ends of the main body, the punching end is formed on an end of the riveting portion away from the mounting portion.

5. The riveting punch of claim 4, wherein the first gas channel extends through the main body and the mounting portion, the riveting portion defines a second gas channel communicating with the firs gas channel, the suction holes communicate with the first gas channel via the second gas channel.

6. The riveting punch of claim 5, wherein the mounting portion define a thread portion around the first gas channel on inner sides of the mounting portion.

7. The riveting punch of claim 4, wherein the diameter of the riveting portion gradually decreases away from the main body.

8. The riveting punch of claim 1, wherein the mounting hole extends through an end surface of the punching end away from the main body, and is arranged on a centre of the end surface, the plurality of suction holes are evenly arranged around the mounting hole.

9. The riveting punch of claim 1, wherein the main body comprises a tangent plane formed on a sidewall of the main body.

10. The riveting punch of claim 9, wherein the main body defines a connecting hole communicating with the first gas channel.

* * * * *